US007745747B2

(12) United States Patent
Carmona et al.

(10) Patent No.: US 7,745,747 B2
(45) Date of Patent: Jun. 29, 2010

(54) MICROSWITCH WITH A FIRST ACTUATED PORTION AND A SECOND CONTACT PORTION

(75) Inventors: Manuel Carmona, Barcelona (ES); Jofre Pallares, Barcelona (ES)

(73) Assignee: Seiko Epson Corporation (JP)

( * ) Notice: Subject to any disclaimer, the term of this patent is extended or adjusted under 35 U.S.C. 154(b) by 630 days.

(21) Appl. No.: 11/725,555

(22) Filed: Mar. 19, 2007

(65) Prior Publication Data

US 2008/0011593 A1 Jan. 17, 2008

(30) Foreign Application Priority Data

Apr. 26, 2006 (EP) ..... 06075951

(51) Int. Cl.
*H01H 57/00* (2006.01)

(52) U.S. Cl. ..... 200/181; 335/78

(58) Field of Classification Search ..... 200/181; 335/78; 333/105, 262; 310/330–332
See application file for complete search history.

(56) References Cited

U.S. PATENT DOCUMENTS

| | | | | |
|---|---|---|---|---|
| 5,121,089 | A | 6/1992 | Larson | |
| 5,619,061 | A | 4/1997 | Goldsmith et al. | |
| 5,801,472 | A | 9/1998 | Wada et al. | |
| 6,218,911 | B1 | 4/2001 | Kong et al. | |
| 6,778,046 | B2 * | 8/2004 | Stafford et al. | 335/78 |
| 6,784,769 | B1 | 8/2004 | Chen | |
| 6,975,193 | B2 * | 12/2005 | Knieser et al. | 335/78 |
| 7,256,670 | B2 * | 8/2007 | Jahnes et al. | 335/78 |
| 7,342,472 | B2 * | 3/2008 | Charvet | 335/78 |
| 7,348,870 | B2 * | 3/2008 | Hsu et al. | 335/78 |
| 7,456,482 | B2 * | 11/2008 | Busta et al. | 257/415 |
| 7,501,911 | B2 * | 3/2009 | Hong et al. | 333/105 |
| 7,501,920 | B2 * | 3/2009 | Yuba et al. | 335/78 |

(Continued)

FOREIGN PATENT DOCUMENTS

| | | |
|---|---|---|
| JP | 5-274953 | 10/1993 |

(Continued)

OTHER PUBLICATIONS

European Search Report.

(Continued)

*Primary Examiner*—Michael A Friedhofer
(74) *Attorney, Agent, or Firm*—Harness, Dickey & Pierce, P.L.C.

(57) ABSTRACT

A microswitch which is electrostatically actuated, which has a first open position and a second closed position in which said switch closes at least a contact line (30); the microswitch comprising a movable part (10) which has at least a first actuated portion (11) and a second contact portion (12), which are mechanically connected by means of at least a connection element (13);

said contact line/s (30) being placed between said first and second portions; wherein in the rest position of the microswitch the actuated portion is at a first distance d1 from the contact line and the contact portion is at a second distance d2 from the contact line;

wherein the operation of the microswitch is the following:

the first actuated portion is actuated by at least an actuating electrode (20), and in response to said actuation and via the connection element (13) the second contact portion (12) is arranged to contact said contact line (30) reducing said second distance d2 to zero.

7 Claims, 3 Drawing Sheets

U.S. PATENT DOCUMENTS

| | | | | |
|---|---|---|---|---|
| 7,545,246 | B2 * | 6/2009 | Kim et al. | 335/78 |
| 7,554,421 | B2 * | 6/2009 | Chou | 333/105 |
| 7,602,261 | B2 * | 10/2009 | Chou et al. | 333/105 |
| 2003/0015936 | A1 | 1/2003 | Yoon et al. | |
| 2004/0022044 | A1 | 2/2004 | Yasuoka et al. | |
| 2005/0057329 | A1 | 3/2005 | Shen et al. | |

FOREIGN PATENT DOCUMENTS

| | | |
|---|---|---|
| JP | 9-251834 | 9/1997 |
| WO | WO 03/060940 | 7/2003 |
| WO | WO 2005/117051 | 12/2005 |
| WO | WO 2006/036560 | 4/2006 |

OTHER PUBLICATIONS

"Low Contact Resistance Series MEMS Switches" Peroulis, et al., University of Michigan, Radiation Laboratory, Electrical Engineering and Computer Science Department, 2002 IEEE MTT-S Digest (pp. 223-226).

* cited by examiner

MICROSWITCH WITH A FIRST ACTUATED PORTION AND A SECOND CONTACT PORTION

FIELD OF THE INVENTION

The invention relates to microelectromechanical systems (MEMS), and more particularly to micromechanical switches.

BACKGROUND OF THE INVENTION

Microelectromechanical systems (MEMS) are among the most promising technologies for implementing low-cost, low-power components for radio-frequency RF applications. The micrometric scale of these devices and the possibility of integration can avoid the problem of the large area occupied by the passive components of current RF systems, replacing all of them by a single MEMS chip or integrating them into the processing chip of the system.

Many actuators built with these technologies have already been developed, although only some of them have found a place in the market. A key point of these devices consists on the performance of the actuation method for every specific device. Many actuation principles are used for actuating MEMS: electrothermal, electrostatic, magnetic, piezoelectric, etc. Nowadays, one of the most used actuation principles in micromechanical switches is the electrostatic actuation. In electrostatic actuation a voltage is applied to two layered conductors (electrodes) to induce charge on the conductors, and the force acting between the induced charges is used as an actuating source. Electrostatic actuation has good general properties: large force achieved for small gaps, direct electrical actuation, etc. Nevertheless, a general drawback is usually the need for a large area, which negatively affects many properties of the devices by reducing speed, decreasing reliability and also increasing costs per area. It also has some other disadvantages, like contact related issues or the self-actuation effect and generally medium-high actuation voltages.

Up to now, most of the microdevices which use an electrostatic actuation are based in the use of an electrode at the movable part (like a cantilever beam or a bridge consisting of a beam anchored at both ends) of the device and a fixed electrode at the substrate.

Current microswitches usually suffer the problem of a deficient contact surface, which in general causes effects like higher switch on-resistance and severe contact degradation. One of the reasons is the curled surface of the movable part when contact happens. This problem is usually solved in part by applying a higher voltage than it is actually needed; but this can have negative effects on the switch performance. Some other times this is solved by using a bulky or large central region of the movable part of the switch.

Another common problem is the self-actuation effect of the switch due to the signals present in the line(s) to be switched. If the signal is large enough, the switch may undesirably close, causing malfunctioning.

FIG. 4*a*-4*e* of U.S. Pat. No. 5,619,061 show a representative case of state of the art microswitches. The working principle is also representative of the state of the art, where the actuating electrodes 405 and 406 exert an electrostatic force over the movable part until a contact is achieved between contact lines 402 and 403 and the movable part 414 and 412. Topologically, the actuating electrodes 405 and 406 and the contact lines 402 and 403 are located at the same height level, and under the movable part 412.

Also, in the way of an example, U.S. Pat. No. 6,784,769-B relates to a microswitch that includes two distributed constant lines disposed close to each other, and a movable element arranged above them, and a driving means (4) for displacing the movable element by an electrostatic force to bring the movable element into contact with the distributed constant lines. The movable element has two projection formed by notching an overlap portion of the movable element which is located on at least one distributed constant line. The projections oppose a corresponding distributed constant line.

U.S. Pat. No. 5,801,472-A describes a micro device with integrated electrostatic actuator, with a fixed portion and a movable portion which are opposite. The relative amount of movement is controlled by controlling electrostatic force operating between both; the movable portion is moved by the Integrated electrostatic actuator and a portion connected to the movable portion which can be operated mechanically. The probe of a scanning probe microscope Is provided to the movable portion of the above actuator. The above transducer is provided with the structure in which a large number of such actuators are arranged two- or one-dimensionally.

Document US-2003/015936-A1 discloses an electrostatic actuator. A multi-layered auxiliary electrode is further arranged between a main electrode and an actuating body, and positive charge or negative charge is applied to the main electrode, respective auxiliary electrodes, and the actuating body such that electrostatic attractive force is generated between the auxiliary electrodes adjacent to the main electrode, between adjacent auxiliary electrodes, and between auxiliary electrodes adjacent to the actuating body.

SUMMARY OF THE INVENTION

The invention refers to a microswitch with first and second portions according to claim 1. Preferred embodiments of the microswitch are defined in the dependent claims.

A first aspect of the invention relates to a microswitch with first and second portions or surfaces for improved contact characteristic and reduced self-actuation. In comparison with conventional switches, the microswitch of the present invention proposes a different configuration, where the contact-or transmission lines are located between the first actuated portion and the second contact portion of the movable part. According to the invention, the microswitch is actuated using electrostatic actuation, and has a first rest or open position and an actuated or closed position in which said switch closes at least a contact line; the microswitch comprises:

a movable part which has at least a first actuated portion and a second contact portion, which are mechanically connected by means of at least a connection element;

said at least one contact line being placed between said first and second portions;

wherein in the rest position of the microswitch the first actuated portion is at a first distance d1 from the contact line and the second contact portion is at a second distance d2 from the contact line;

wherein the operation of the microswitch is the following:

the first actuated portion is actuated by at least an actuating electrode, and in response to said actuation by the actuating electrode and via the connection element the second contact portion is arranged to contact said contact line reducing said second distance d2 to zero.

Thus, according to the present invention, the improved microswitch overcomes the above problems: as the microswitch has differentiated actuated and contact portions, it has the properties of keeping a nearly flat contact from the very beginning of the contact action, thereby improving contact properties. Additionally, there exists self-compensation of the actuation force caused by the signals at the lines, reducing or eliminating the self-actuation phenomena.

The microswitch of the present invention, compared to state-of-the-art switches, has improved characteristics such as: low on-resistance, low contact degradation and reduced self-actuation effect.

Preferably the at least actuating electrode forms integral part of the movable part of the microswitch; said actuating electrode may be of the type described in European patent application No. 06075578.2. It is then possible that the microswitch includes integral and non-integral actuating electrodes.

The distances d1 and d2 may be substantially the same; or d1 may be bigger than d2. The distances d1 and d2 represent the minimum distances between the involved portions, that is, in the case of d1, the minimum distance between the first actuated portion and the contact line; and in the case of d2, the minimum distance between the second contact portion and the contact line. This does not necessarily mean that the involved elements (first and second portions, and contact line/s) are completely planar nor completely parallel between them.

The microswitch can have at least two connection elements. Said connection element/s can be made of dielectric material.

Further electrodes can be placed for actuating over the movable part in order to open the switch. Said further electrode/s to open the switch can also be integral part of the movable part of the switch.

This allows for a wide range of applications where switches are needed, such as: power amplifier output matching network, switched phase array, etc.

SHORT DESCRIPTION OF THE DRAWINGS

DETAILED DESCRIPTION OF THE DRAWINGS

Figure 1:
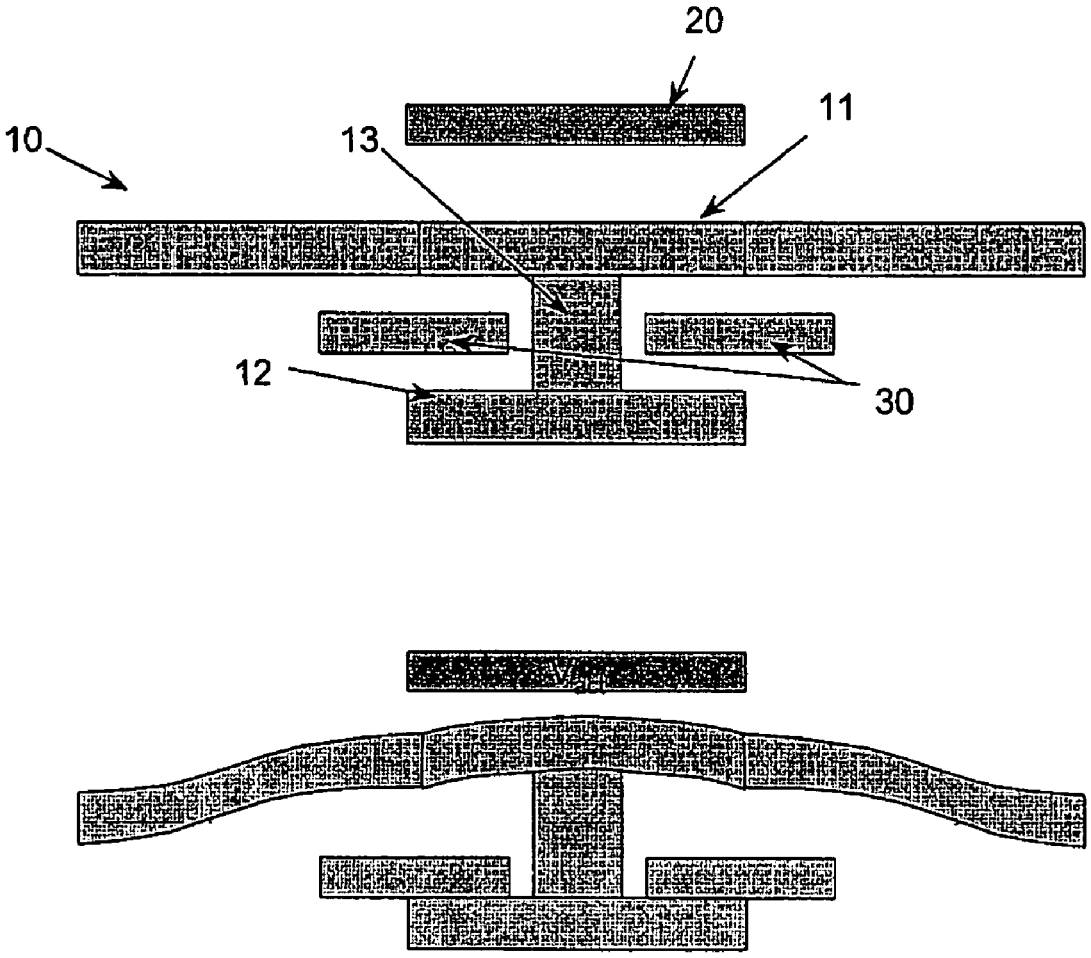
FIG. 1 shows a cross section of a first embodiment of a microswitch of the invention, illustrating the electrostatic actuation principle.

As shown in FIGS. 1-5, the invention consists of an electrostatically actuated switch which has a movable part 10 having two different first and second portions or surfaces 11, 12. The first portion or surface 11 is actuated by an actuating electrode 20 for closing the microswitch. This first portion or surface 11 usually suffers a non planar bending when it is actuated. The microswitch further has the second portion or surface 12 which serves as the contact of the microswitch, and which surface is kept almost flat during the movement of the movable part of the microswitch. The first and second surfaces are mechanically linked via a connection element 13. The contact line/s 30 are placed between these first and second surfaces.

Figure 6:
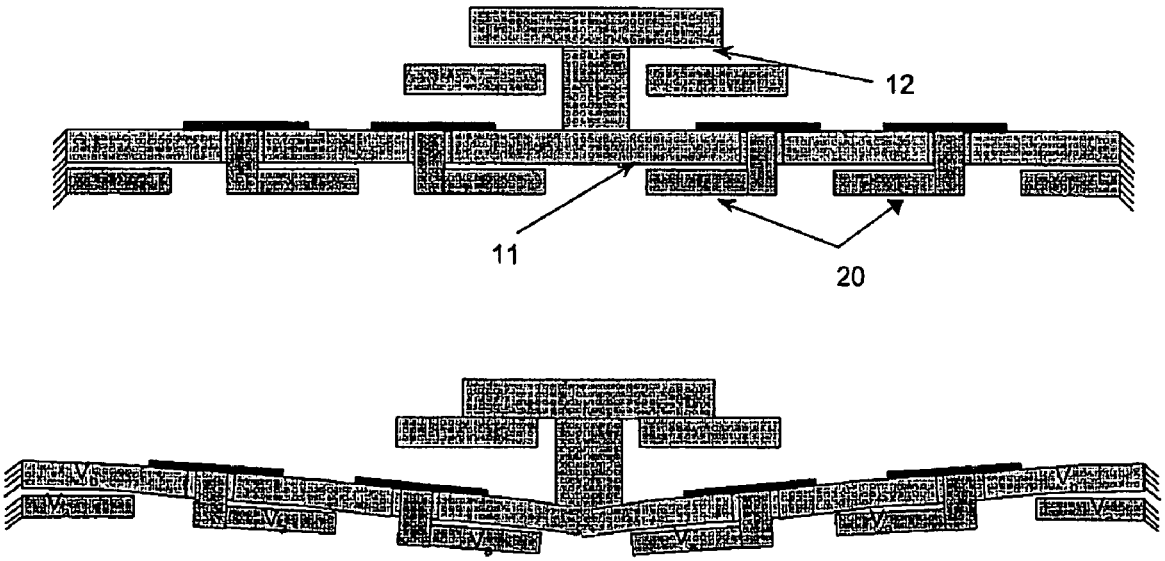
FIG. 6 shows a further embodiment for a microswitch, where the actuating electrodes form integral part of the movable part of the microswitch.

FIG. 6 shows a further embodiment of the microswitch, having a plurality of actuating electrodes 20; these actuating electrodes form integral part of the movable part 10 of the microswitch. These actuating electrodes may be of the type described in European patent application ep 006075578.2.

In all the embodiments shown in FIGS. 1-6, the actuated surface should not contact the actuating electrode before the second surface contacts the contact lines.

The shape of the surfaces can be chosen in such a way that the forces generated by a signal in the contact line/s are nearly the same for both surfaces. This way, any self-actuation due to this signal is significantly reduced or nearly eliminated.

FIG. 1 shows a cross-section of a first embodiment of a microswitch, and it also illustrates the operation of the same. In the rest position, the microswitch is open: there is no electrical contact between lines via the movable part of the microswitch. When enough voltage $V_{act}$ (positive or negative) is applied to the actuating electrode, the first actuated surface 11 suffers a force towards the actuating electrode 20, causing its deformation. The second contact surface 12 makes a planar (or nearly planar) contact with the contact line/s 30.

The gap between the actuating electrode and the first actuated surface has to be large enough for preventing their contact (of said actuating electrode and the first actuated surface) until the line/s and the second contact surface have contacted. This may be achieved in the embodiments shown in FIGS. 1-5 by providing a larger gap between the actuating electrode 20 and the first actuated surface 11 than the gap between the contact line/s 30 and the second surface 12. In the embodiment shown in FIG. 6, this may be achieved by providing an appropriate number of actuating electrodes 20 over the movable part 10 of the microswitch, so as to bend it sufficiently in order that the second contact surface makes contact with the contact line/s.

Figure 2:
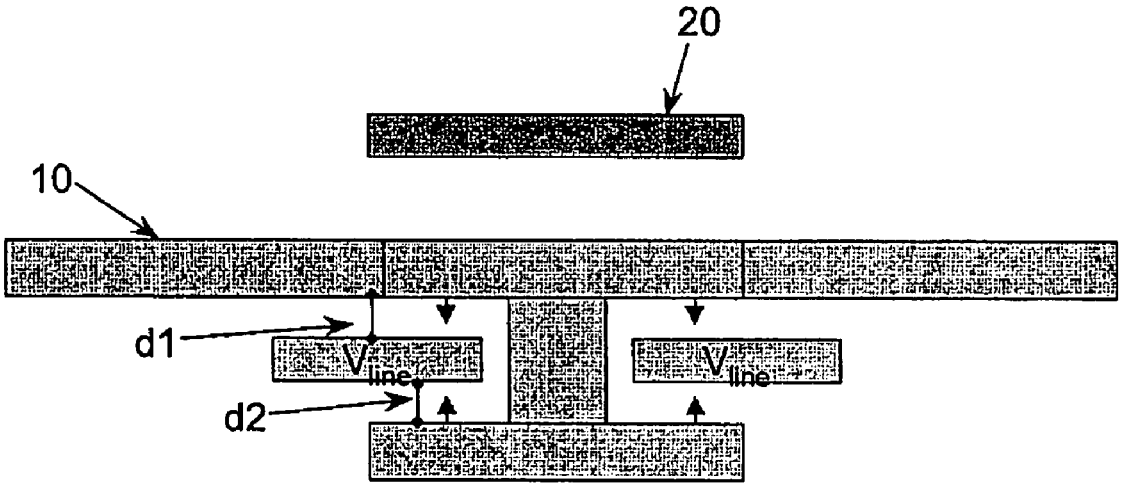
FIG. 2 illustrates the elimination or reduction of the self-actuation effect for the microswitch shown in FIG. 1.

FIG. 2 schematically shows how the reduction of the microswitch self-actuation is achieved with the present invention. At rest, the force due to any voltage $V_{line}$ in the line/s is the same or substantially equivalent for both portions or surfaces of the movable part of the microswitch. Comparing this switch to the case of a single surface switch, a much larger voltage at the line/s is needed in order to accidentally close the switch due to self-actuation.

The connection elements 13 connecting both first and second surfaces can be designed in different ways so as to optimise the characteristics of the microswitch, like contact properties of operating voltages; etc. For example, these connection elements can be positioned in such a way that contact pressure is applied over the surfaces of the contact line/s 30. Also, these connection element/s 13 can be made of a different material to those of the movable part of the microswitch, as for example, dielectric layer.

Figure 3:
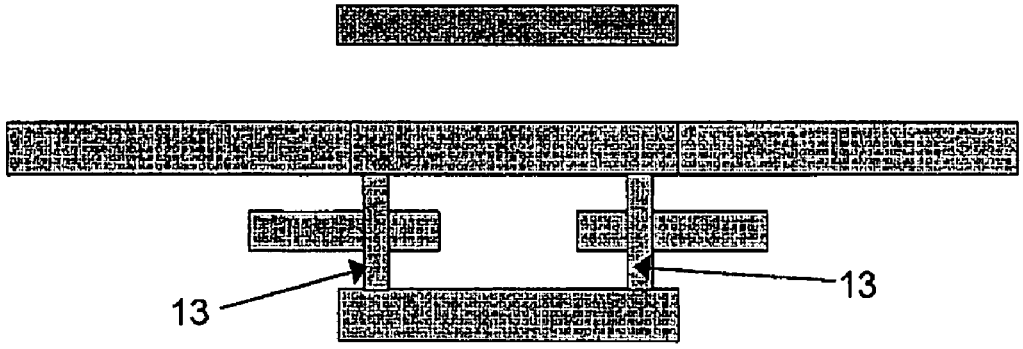
FIGS. 3, 4 and 5 show cross sections of a second, third and fourth embodiments, respectively, for a microswitch of the invention.
Figure 4:
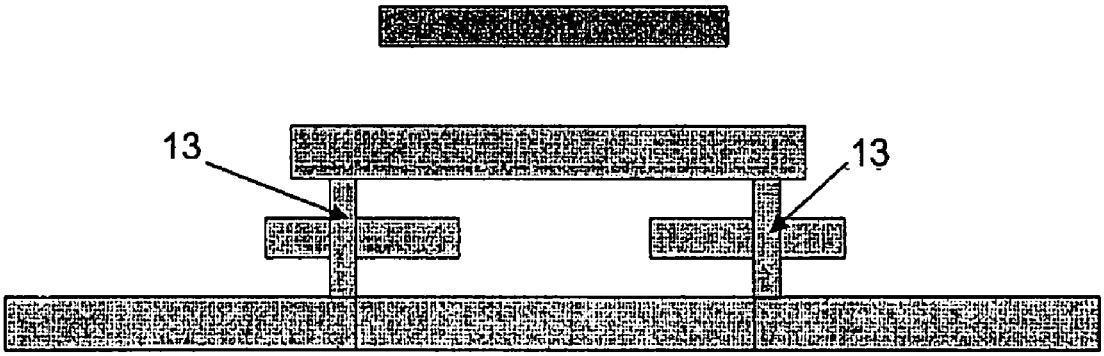
Figure 5:
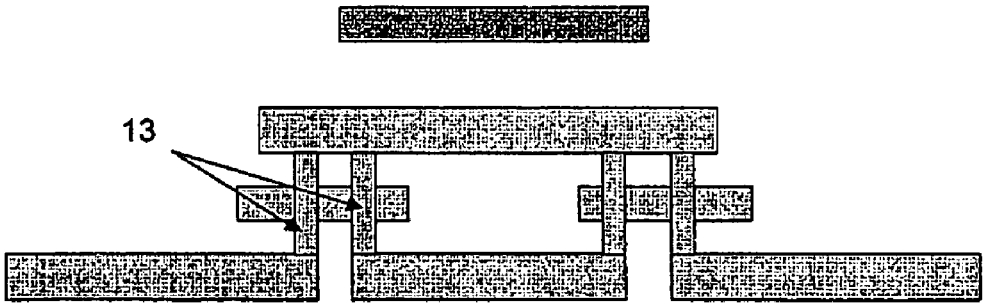

Further embodiments of the microswitch are shown in FIGS. 3, 4 and 5. FIG. 3 shows just another possible position of the connection elements used for connecting both surfaces, which can be designed to distribute the force over the contact lines in an optimised way. FIGS. 4 and 5 show two different ways to use the connection elements of the microswitch from another layer different than the actuated surface.

Figure 7:
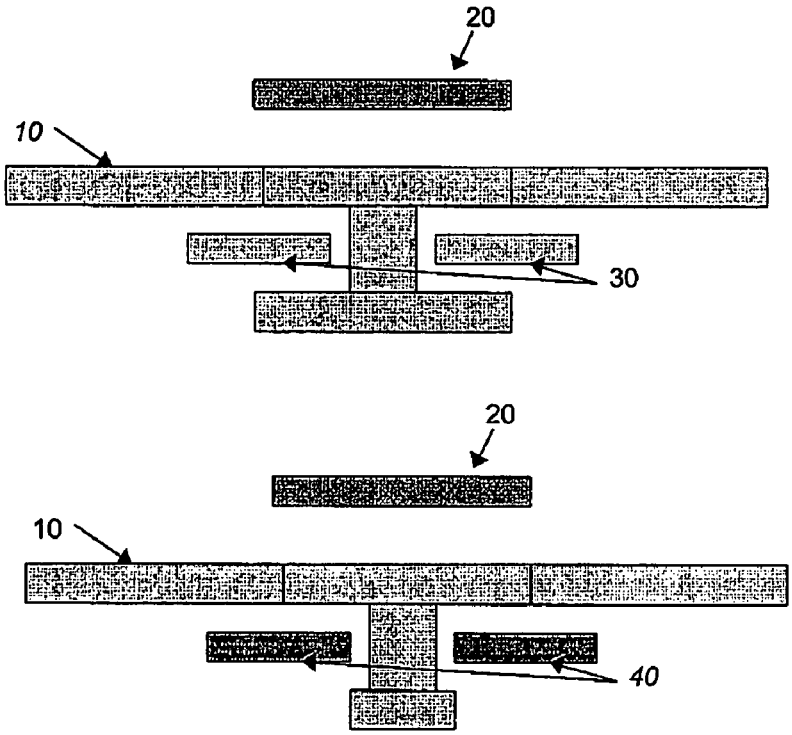
FIG. 7 shows another embodiment of the microswitch of the invention, where additional electrodes are placed in order to open the switch. Two perpendicular cross-sections of the microswitch are shown.

Additionally, further electrodes can be placed for actuating over the movable part to open the switch. FIG. 7 shows one possible implementation, by using additional electrodes 40, which in this specific implementation are situated at the same level of the contact lines, to actuate over the first portion.

The fabrication of these devices can be done with usual MEMS fabrication processes or even with standard CMOS process. The structure would only need, for the switches shown in FIGS. 1-5, of four conducting layers in a "vertical" switch structure. The connection element/s used for connecting both surfaces can be carried out by the use of metal vias or just by appropriate lithography design. For an "in-plane" device, the described shape could just be achieved by the design of the photolithographic masks.

The invention claimed is:

1. A microswitch which is actuated using electrostatic actuation, said microswitch having a first rest or open position and a second actuated or closed position in which said switch closes at least one contact line, wherein the microswitch comprises:

a movable part which has at least a first actuated portion and a second contact portion which are mechanically connected by at least one connection element;

said at least one contact line being placed between said first and second portions;

wherein in the rest position of the microswitch, the first actuated portion is at a first distance d1 from the contact line and the second contact portion is at a second distance d2 from the contact line;

wherein operation of the microswitch is as follows:

the first actuated portion is actuated by at least one actuating electrode, and in response to said actuation by the actuating electrode and via the at least one connection element the second contact portion is arranged to contact said contact line reducing said second distance d2 to zero; and wherein the at least one actuating electrode forms an integral part of the movable part of the microswitch.

2. The microswitch according to claim 1, wherein d1 and d2 are substantially the same.

3. The microswitch according to claim 1, wherein d1 is larger than d2.

4. The microswitch according to claim 1, wherein there are at least two connection elements.

5. The microswitch according to claim 1, wherein said at least one connection element is made of dielectric material.

6. The microswitch according to claim 1, wherein further electrodes are placed for actuating over the movable part in order to open the switch.

7. The microswitch according claim 6, wherein said further electrodes to open the switch are an integral part of the movable part of the switch.

* * * * *